US008474951B2

(12) United States Patent
Inoue et al.

(10) Patent No.: US 8,474,951 B2
(45) Date of Patent: Jul. 2, 2013

(54) LIQUID EJECTION HEAD

(75) Inventors: Tomoyuki Inoue, Tokyo (JP); Ken Tsuchii, Sagamihara (JP); Eisuke Nishitani, Tokyo (JP); Toru Yamane, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 160 days.

(21) Appl. No.: 13/176,650

(22) Filed: Jul. 5, 2011

(65) Prior Publication Data

US 2012/0019594 A1 Jan. 26, 2012

(30) Foreign Application Priority Data

Jul. 8, 2010 (JP) ..... 2010-155840

(51) Int. Cl.
*B41J 2/15* (2006.01)
*B41J 2/145* (2006.01)

(52) U.S. Cl.
USPC ..... 347/40; 347/42; 347/65

(58) Field of Classification Search
USPC ..... 347/9–12, 15, 20, 40, 42, 43, 44, 347/47, 49, 65, 85–86
See application file for complete search history.

(56) References Cited

U.S. PATENT DOCUMENTS 8,016,387 B2 * 9/2011 Watanabe ..... 347/50

FOREIGN PATENT DOCUMENTS

JP 5-330066 A 12/1993

* cited by examiner

*Primary Examiner* — Thinh Nguyen
(74) *Attorney, Agent, or Firm* — Canon USA Inc IP Division

(57) ABSTRACT

A liquid ejection head includes: a first and a second common liquid chamber formed in a substrate; a first nozzle array in which short and long nozzles are connected to the first common liquid chamber and alternately arranged on one side of the chamber; a second nozzle array in which short and long nozzles are connected to the first common liquid chamber and alternately arranged on the other side; a third nozzle array in which short and long nozzles are connected to the second common liquid chamber and alternately arranged on one side of the chamber; and a fourth nozzle array in which short and long nozzles are connected to the second common liquid chamber and alternately arranged on the other side; wherein the long and short nozzles formed on the one side and the long and short nozzles formed on the other side are disposed within a pitch P.

11 Claims, 9 Drawing Sheets

LIQUID EJECTION HEAD

BACKGROUND OF THE INVENTION

1. Field of the Invention

The present invention relates to a liquid ejection head having a plurality of nozzle arrays.

2. Description of the Related Art

A recording device such as a printer, a copy machine, and a facsimile is configured to record an image of a dot pattern on a recording medium such as a paper sheet and a plastic thin plate based on image information. The recording method of the recording device can be classified into an ink jet method, a wire dot method, a thermal method, a laser beam method, and the like. Among them, the recording device that uses the ink jet method (ink jet recording device) ejects and flies ink droplets (liquid) from ejection orifices of nozzles of a recording head and attaches the ink droplets to a recording medium to perform recording.

In recent years, high-speed recording, high resolution, high image quality, low noise, and the like are required for recording devices, and the ink jet recording device is one of the recording devices that satisfy such requirements.

A configuration of a liquid ejection head used in a recording device that ejects liquid such as ink in the manner as described above will be described below. The liquid ejection head includes an element substrate provided with energy generating elements, for example, electrothermal transducers for generating energy for ejecting liquid and a flow passage forming member (also referred to as "orifice substrate") that is bonded to the element substrate and forms liquid supply paths (passages). The flow passage forming member has a plurality of nozzles in which liquid flows, and an opening at the top end of the nozzle forms an ejection orifice for ejecting liquid droplets. The nozzle has a bubbling chamber in which bubbles are generated by the energy generating element and a passage for supplying liquid to the bubbling chamber. An electrothermal transducer is disposed in the bubbling chamber in the element substrate. A supply port is provided in a main surface of the element substrate which is in contact with the flow passage forming member, and a back surface supply port is provided in the back surface opposite to the main surface. A common liquid chamber is provided between the supply port and the back surface supply port. In the flow passage forming member, ejection orifices are provided at positions facing the electrothermal transducers on the element substrate.

In the recording head configured as described above, liquid supplied from the back surface supply port to the common liquid chamber is supplied to each nozzle through the supply port and filled in the bubbling chamber. The liquid filled in the bubbling chamber is flown in a direction approximately perpendicular to the main surface of the element substrate by the bubbles generated when the liquid is film-boiled by the electrothermal transducer, and ejected from the ejection orifice as a liquid droplet.

To achieve a higher resolution recording image by the liquid ejection head, it is desired to reduce the size of the liquid droplet and reduce the dot diameter formed on a recording medium. However, if the size of the liquid droplet is reduced, the throughput decreases unless the number of liquid droplets ejected to a recording medium such as paper per unit time is increased. Therefore, as a method for increasing the number of liquid droplets ejected per unit time, it is considered to increase the number of the nozzles.

In recent years, to achieve recording of higher resolution image at higher speed, liquid ejection head having wider printing width and higher density of nozzle arrangement is required. Hereinafter, a conventional example of a liquid ejection head corresponding to the requirements and the recording method thereof will be described.

In this liquid ejection head, heaters are provided on a silicon substrate as energy generating elements, and nozzles are formed by nozzle members. Liquid is supplied from the back surface of the silicon substrate through a liquid supply port formed as a hole penetrating the silicon substrate. Electric energy is applied to the heater to heat and bubble the liquid, and thereby the liquid is ejected from the ejection orifice to perform recording on a recording medium. The electric energy is applied to the heater by a driving transistor provided on the silicon substrate through an electric circuit substrate and a flexible circuit substrate according to a signal inputted from outside via an electric connector. Methods for forming high density and high accuracy nozzles and ejection orifices in such a liquid ejection head are disclosed in Japanese Patent Laid-Open No. 05-330066.

To perform high-speed printing (recording of image) by using such a liquid ejection head, a method is known in which a large number of liquid ejection orifices are arranged over the entire width of the recording medium. In this case, it is possible to record all print data (image data) while scanning the recording medium once with respect to the liquid ejection head (one-pass drawing method using a full multi-head). In such a liquid ejection head, if there is only one defective nozzle among a large number of nozzles, defective printing occurs. Therefore, a method is proposed in which, even if there is a defective nozzle, defective printing is complemented by using the other nozzles. Such a method will be described with reference to FIG. 7. In FIG. 7, each square box 501 indicates a pixel on the recording medium 500 and each black dot 502 indicates the ejected liquid.

FIG. 7 shows an example of a conventionally known method for improving defective printing when there are some defective nozzles. In FIG. 7, the nozzle array of the liquid ejection head is arranged along the X direction, and the liquid ejection head performs printing while scanning the recording medium 500 in the Y direction. Although the liquid ejection head should form a printing pattern as shown in FIG. 7A, a white streak is generated as shown in FIG. 7B if there is a nozzle that cannot eject liquid for some reason. To improve this, as shown in FIG. 7C, complementary dots 503 are ejected to the positions adjacent to pixels to which the non-ejection nozzle should eject liquid by using nozzles adjacent to the non-ejection nozzle.

Further, as another example of complementing the non-ejection nozzle, in U.S. Pat. No. 5,984,455A, a primary nozzle and a secondary nozzle arranged along the scanning direction are disclosed. If a defect is detected in either the primary nozzle or the secondary nozzle, in place of a pressure generating element (energy generating element) of the defective nozzle, a pressure generating element of the other nozzle is operated. In this way, data (pixels) that should be formed by the defective nozzle are formed by the other nozzle located on the same axis in the scanning direction as that of the defective nozzle.

If there are a plurality of nozzles on the same axis in the scanning direction, not only it is possible to complement the non-ejection nozzle and improve throughput, but also there is an advantage that liquid droplets ejected from a plurality of different nozzles can be provided to the same pixel array on the recording medium. Thereby, a high resolution image quality that seems as if it were drawn by multiple passes can be obtained. This will be described with reference to FIG. 8. FIG. 8A shows a situation in which an image is formed on the recording medium 500 by a liquid ejection head having only one nozzle array L1 and having only a single nozzle on the same scanning axis (axis along the scanning direction Y). In FIG. 8, the dots denoted by reference numeral 502 indicate liquid droplets landed on the recording medium 500 (landed dots). If the nozzles in the nozzle array L1 include a nozzle n1 whose liquid droplet lands on a position shifted from an ideal landing position for some reason, a streak 5 is formed along the scanning direction Y in the recording image (see FIG. 8A). On the other hand, FIG. 8B shows a situation in which an image is formed on the recording medium 500 by a liquid ejection head having four nozzle arrays L1 to L4 and including four different nozzles on the same axis along the scanning direction Y. In this case, an influence to an image caused by one defective nozzle n1 can be suppressed by the other three normal nozzles n2 to n4. Specifically, the liquid droplet 505 from the nozzle n1 is formed every four dots, so the influence thereof is difficult to recognize. As a result, a higher resolution image can be obtained in the configuration including a plurality of nozzle arrays shown in FIG. 8B than in the configuration including a single nozzle array shown in FIG. 8A.

There is a method for increasing recording density in the nozzle array direction by reducing the amount of liquid droplet to be ejected in order to obtain high resolution image. Therefore, it is known that, in each nozzle array, nozzles are arranged in a zigzag pattern instead of simply and linearly arranging the nozzles. Specifically, a zigzag shaped nozzle array is formed by alternately arranging a nozzle located far from the common liquid chamber (hereinafter also referred to as "long nozzle") and a nozzle located near the common liquid chamber (hereinafter also referred to as "short nozzle"). Such a zigzag shaped nozzle array improves density of the nozzle arrangement compared with a linear nozzle array, so recording density of an image can be improved.

To obtain high resolution image, it is desired that the long nozzles and the short nozzles arranged alternately have substantially the same ejection characteristics such as the amount of ejection and the speed of ejection. However, a difference of ejection characteristics may occur between the long nozzle and the short nozzle due to manufacturing tolerance, driving condition, and operating environment. Because of this, density unevenness and landing error occur between a pixel array on a recording medium formed by using only the long nozzle and a pixel array formed by using only the short nozzle, and a good image may not be obtained.

Further, the position and the shape of a dot formed by a liquid droplet landed on a recording medium are varied depending on the orientation of the nozzle from the common liquid chamber, and the difference of the orientations of the nozzles may affect the image quality. This will be described with reference to FIG. 9. As shown in FIGS. 9B and 9C, when nozzle arrays LL and LR are arranged on both sides of the common liquid chamber 912 having a slit-like opening in the substrate 910, the orientations Dnl and Dnr of the passages connected from the common liquid chamber 912 to the nozzles Nnl and Nnr are opposite to each other for the nozzle arrays LL and LR. In other words, the nozzle arrays LL and LR are designed to be line symmetric to each other with respect to the slit-like opening of the common liquid chamber 912 that is used as the central axis. In the example shown in FIG. 9C, the nozzle arrays LL and LR are formed by nozzles that are linearly arranged.

Between the pair of nozzle arrays provided on both sides of the common liquid chamber 912, the shape of the nozzle (position of the opening and shapes of the passage and the ejection orifice) may be shifted or deformed in the manufacturing process, or changes over time in the ejection characteristics may occur during use in each nozzle array. Therefore, a difference of characteristics such as the speed of ejection and the amount of ejection may occur between the nozzle arrays LL and LR.

In addition, the shape of a dot landed on the recording medium may vary depending on the nozzle array. In each nozzle of the liquid ejection head, it is known that a liquid droplet ejected by one ejection operation is divided into a main droplet 901*a* or 901*b* and a satellite droplet 902*a* or 902*b* smaller than the main droplet (see FIG. 9B). The flying speed and the ejection angle of the main droplet 901*a* or 901*b* and the satellite droplet 902*a* or 902*b* are different from each other, so the two types of droplets ejected while the nozzles are scanning the recording medium are landed at different positions on the recording medium. If the dots formed by the satellite droplets 902*a* and 902*b* are too distinct, the dots can be viewed at positions irrelevant to the image data, so the dots causes degradation of the image. The degree of the shift of landing position of the main droplets 901*a* and 902*b* and the satellite droplets 902*a* and 902*b* may vary depending on the orientations of the passages 916*l* and 916*r* from the common liquid chamber 912 to each nozzle Nnl and Nnr. This is shown by FIG. 9A. The satellite droplets 902*a* and 902*b* are easily affected by the orientations of the passages 916*l* and 916*r* in the forming process of the droplets ejected from the nozzles Nnl and Nnr, and may be flown at an ejection angle different from that of the main droplets 901*a* and 901*b*. Thereby, the shift between the landing positions, which are formed on the recording medium, of the main droplet 901*b* and the satellite droplet 902*b* ejected from the nozzle array LL may be different from the shift between the landing positions, which are formed on the recording medium, of the main droplet 901*a* and the satellite droplet 902*a* ejected from the nozzle array LR. Therefore, if pixel arrays are formed by using one nozzle array only, density unevenness and streaks may occur between the pixel arrays and pixel arrays formed by using the other nozzle array only. Thus, a good image may not be obtained.

As described above, if there are nozzles whose passages have different lengths or nozzles whose orientations from the common liquid chamber are different, a difference of ejection performances of liquid droplets ejected from the nozzles occurs, and as a result there is a problem that the quality of recording image degrades. In particular, in a zigzag shaped nozzle array in which nozzles are densely arranged, there is a problem that the recording image is affected by a difference of ejection characteristics caused by a difference of the length of the passage, a difference of ejection characteristics generated by a difference of the orientations of the passages from the common liquid chamber to each nozzle, and a difference of landing positions of the satellite droplets.

In particular, in the case of a line head which has nozzle arrays having a length corresponding to the recording width and performs recording by scanning the recording medium by the recording head only once, the degradation of the image quality due to the above problems appears remarkably.

SUMMARY OF THE INVENTION

The present invention provides a liquid ejection head including: a plurality of nozzles for ejecting liquid; a substrate including energy generating elements for generating energy for ejecting liquid from the nozzles; a first common liquid chamber and a second common liquid chamber which are formed along the substrate and into which liquid is introduced; a first nozzle array in which a plurality of nozzles are connected to the first common liquid chamber, the plurality of nozzles including short nozzles arranged a distance from the first common liquid chamber which is relatively short and long nozzles arranged a distance from the first common liquid chamber which is relatively long, which are alternately arranged on one side of the first common liquid chamber at a predetermined pitch P along the first common liquid chamber; a second nozzle array in which a plurality of nozzles are connected to the first common liquid chamber, the plurality of nozzles including short nozzles arranged a distance from the first common liquid chamber which is relatively short and long nozzles arranged a distance from the first common liquid chamber which is relatively long, which are arranged on the side opposite to the one side of the first common liquid chamber at the pitch P; a third nozzle array in which a plurality of nozzles are connected to the second common liquid chamber, the plurality of nozzles including short nozzles arranged a distance from the second common liquid chamber which is relatively short and long nozzles arranged a distance from the second common liquid chamber which is relatively long, which are alternately arranged on one side of the second common liquid chamber at the pitch P along the second common liquid chamber; and a fourth nozzle array in which a plurality of nozzles are connected to the second common liquid chamber, the plurality of nozzles including short nozzles arranged a distance from the second common liquid chamber which is relatively short and long nozzles arranged a distance from the second common liquid chamber which is relatively long, which are arranged on the other side of the second common liquid chamber at the pitch P, wherein the long nozzle and the short nozzle formed on the one side and the long nozzle and the short nozzle formed on the other side are disposed within a range of the pitch P in a direction in which the plurality of nozzles are arranged.

Further features of the present invention will become apparent from the following description of exemplary embodiments with reference to the attached drawings.

DESCRIPTION OF THE EMBODIMENTS

Hereinafter, embodiments of the present invention will be described with reference to the drawings. The present invention can be applied to an ordinary printer, a copy machine, a facsimile having a communication system, a word processor or the like that has a printing unit, and/or a multi-functional recording device in which the above devices are combined. In the embodiments described below, as an example, an inkjet recording head that ejects ink will be described. However, the liquid ejection head of the present invention is not limited to a liquid ejection head that ejects ink, but may be a liquid ejection head that ejects any liquid.

Figure 1:
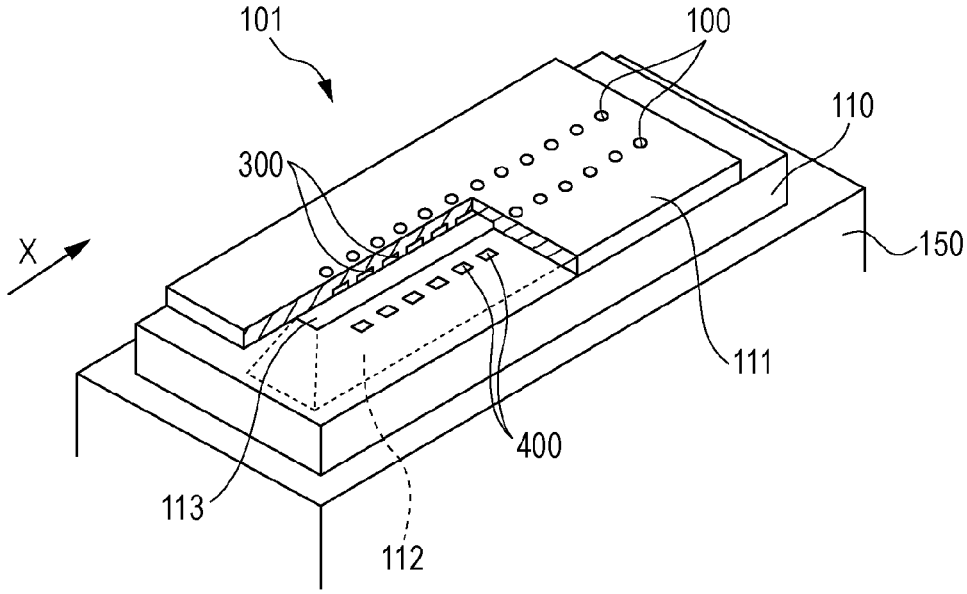
FIG. 1 is a schematic perspective view of a liquid ejection head.

FIG. 1 is a perspective view schematically showing a liquid ejection head (hereinafter simply referred to as "recording head").

The recording head 101 has a silicon (Si) substrate 110 provided with a plurality of recording elements (energy generating elements) 400 including, for example, heat generating resistance bodies and pressure generating elements and a flow passage forming member 111 disposed on the Si substrate 110 to cover the recording elements 400 on the top surface. In FIG. 1, for convenience, a part of the flow passage forming member 111 is cut off and shown. Although, in the present embodiment, the Si substrate 110 is used because the Si substrate can be easily processed, a substrate formed of a material other than Si may be used in the present invention.

First, an entire configuration of the recording head 101 will be briefly described. The Si substrate 110 has a common liquid chamber 112 formed to penetrate the substrate 110, and the common liquid chamber 112 has an opening that forms a longitudinal liquid supply port 113 on the top surface of the substrate 110. Although, in FIG. 1, only the recording elements 400 forming a row on one side are shown, a plurality of the recording elements (energy generating elements) 400 are arranged on both sides of the liquid supply port 113 along the longitudinal direction of the liquid supply port 113. Any type of recording elements 400 may be used if the recording elements 400 can generate energy to eject liquid from the nozzles 100. The recording element 400 can be formed of, for example, a heat generating resistance body. The heat generating resistance body generates heat when a voltage is applied to the heat generating resistance body via electric wiring not shown in the drawings, and heats liquid to provide ejection energy to the liquid.

Figure 2A:
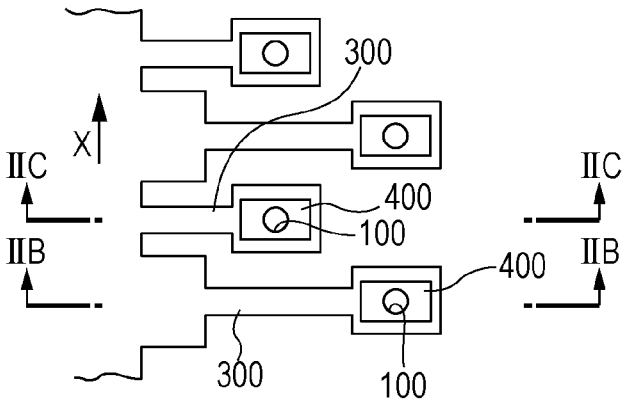
FIG. 2A is a conceptual diagram showing an arrangement of nozzles forming a zigzag shaped nozzle array.

Although, in FIG. 1, the recording elements 400 are linearly aligned along the longitudinal direction of the liquid supply port 113, actually, the recording elements 400 are arranged in a zigzag pattern as described below. Similarly, although, in FIG. 1, the nozzles 100 are linearly aligned in the X direction along the common liquid chamber 112, actually, the recording elements 400 are arranged in a zigzag pattern as shown in FIG. 2A. Although only one liquid supply port 113 and only one common liquid chamber 112 connected to the liquid supply port 113 are shown in FIG. 1, actually, there are at least two liquid supply ports 113 and at least two common liquid chambers 112.

Figure 2B:
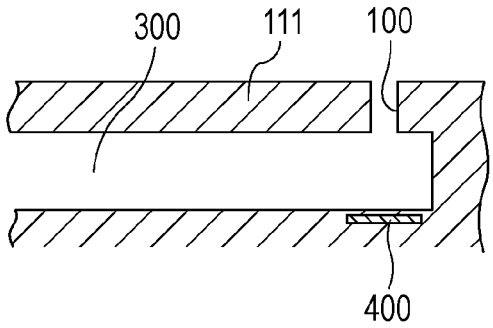
FIGS. 2B and 2C are respectively schematic cross-sectional views taken along the lines IIC-IIC and IIB-IIB of FIG. 2A.
Figure 2C:
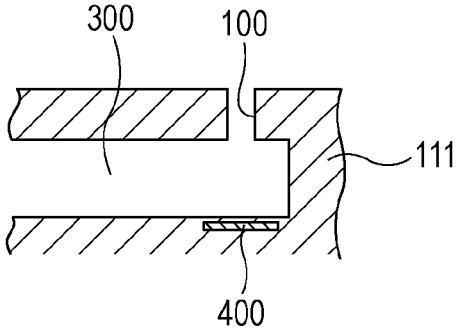

FIG. 2A is a conceptual diagram showing an arrangement of nozzles forming a zigzag shaped nozzle array. FIGS. 2B and 2C are respectively schematic cross-sectional views taken along the lines IIC-IIC and IIB-IIB of FIG. 2A.

The nozzles 100, which are disposed at positions facing corresponding recording elements 400 and have an opening for ejecting liquid, are formed in the flow passage forming member 111. The plurality of nozzles 100 are aligned on both sides of the liquid supply port 113 and the common liquid chamber 112. A plurality of passages 300 for guiding liquid supplied from the liquid supply port 113 through the common liquid chamber 112 to each nozzle 100 are formed between the flow passage forming member 111 and the top surface of the Si substrate 110.

Although, in the present embodiment, the common liquid chamber 112, the passages 300, the nozzles 100 are formed by using two members which are Si substrate 110 and the flow passage forming member 111, these constituent elements may be formed in a single substrate. Instead of the above, these constituent elements may be formed by using a substrate including three or more members. The recording elements 400 generating energy for ejecting liquid are provided in a substrate as described above.

The recording head 101 is positioned and fixed on a liquid supply member 150 in which a passage (not shown in the drawings) for supplying liquid to the common liquid chamber 112 of the Si substrate 110 is formed, and operates as follows. First, when a voltage from outside is applied to a heat generating resistance body functioning as the recording element 400 via electric wiring not shown in the drawings, the heat generating resistance body generates heat. The liquid in the passage 300 generates bubbles by the heat energy, and the generated bubbles pushes out the liquid in the passage 300 from the nozzle 100. In this way, a liquid droplet is ejected from the opening of the nozzle 100. The recording head 101 performs the above operation in a state in which the top surface of the flow passage forming member 111, that is, an ejection port surface in which openings from which liquid droplets are ejected are formed faces a recording medium such as a paper sheet. Thereby, the ejected liquid droplets are attached to the recording medium, so that recording is performed.

Next, an arrangement of nozzle arrays formed in the recording head 101 of the present embodiment will be described in detail with reference to FIG. 3.

Figure 3A:
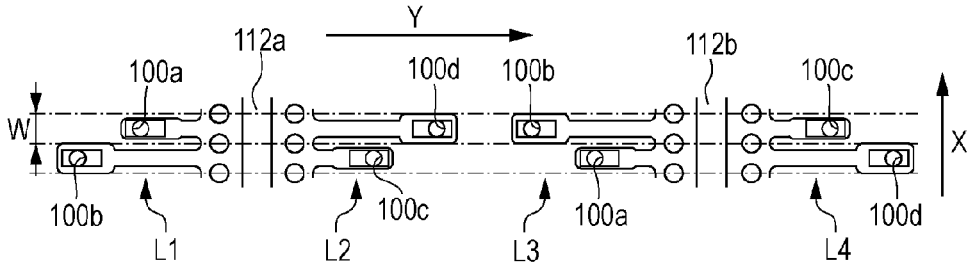
FIG. 3A is a schematic diagram showing a nozzle arrangement according to a first embodiment.
Figure 3B:
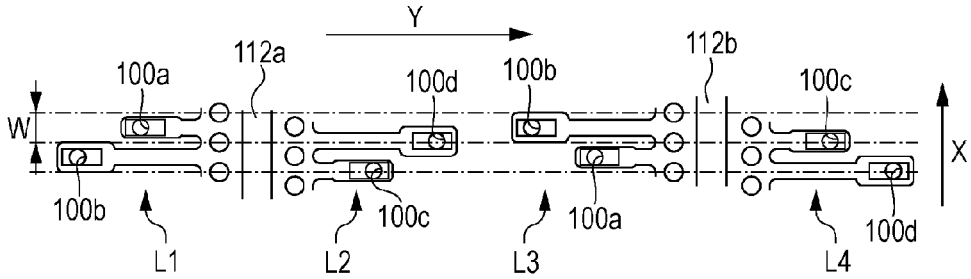
FIG. 3B is a schematic diagram showing a nozzle arrangement according to a second embodiment.
Figure 3C:
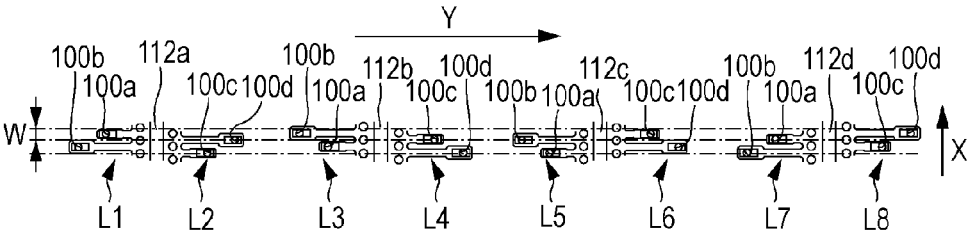
FIG. 3C is a schematic diagram showing a nozzle arrangement according to a third embodiment.

As shown in FIG. 3A, a first common liquid chamber 112*a* and a second common liquid chamber 112*b* that are formed in slit shapes in parallel with each other are formed in a substrate in which the recording elements are provided. The liquid ejected from the nozzles 100 is introduced into the common liquid chambers 112*a* and 112*b*. Zigzag shaped nozzle arrays (first to fourth nozzle arrays) L1, L2, L3, and L4 are formed on both sides of the first common liquid chamber 112*a* and on both sides of the second common liquid chamber 112*b*. In FIG. 3A, two nozzles are shown among the nozzles that form the zigzag shaped nozzle arrays L1 to L4. That is, the nozzles are shown for about one cycle along the nozzle array direction X.

The first nozzle array L1 and the third nozzle array L3 are formed by first nozzles 100*a* and second nozzles 100*b* that are alternately arranged to have a zigzag shape (also see FIG. 2A). The first nozzle 100*a* (hereinafter also referred to as "left-facing short nozzle") is located near the common liquid chamber 112*a* or the common liquid chamber 112*b* and the second nozzle 100*b* (hereinafter also referred to as "left-facing long nozzle") is located far from the common liquid chamber 112*a* or the common liquid chamber 112*b*. The first and the second nozzles 100*a* and 100*b* extend in the left direction from the common liquid chamber 112*a* or 112*b*.

The first nozzle array L1 is located on one side of the first common liquid chamber 112*a* and far from the second common liquid chamber 112*b*. The third nozzle array L3 is located on one side of the second common liquid chamber 112*b* and near the first common liquid chamber 112*a*. The nozzles included in the first nozzle array L1 are connected to the first common liquid chamber 112*a* and the nozzles included in the third nozzle array L3 are connected to the second common liquid chamber 112*b*.

The second nozzle array L2 and the fourth nozzle array L4 are formed by third nozzles 100*c* and fourth nozzles 100*d* that are alternately arranged to have a zigzag shape. The third nozzle 100*c* (hereinafter also referred to as "right-facing short nozzle") is located near the common liquid chamber 112*a* or the common liquid chamber 112*b* and the fourth nozzle 100*d* (hereinafter also referred to as "right-facing long nozzle") is located far from the common liquid chamber 112*a* or the common liquid chamber 112*b*. The third and the fourth nozzles 100*c* and 100*d* extend in the right direction from the common liquid chamber 112*a* or 112*b*.

The second nozzle array L2 is provided on the opposite side of the first common liquid chamber 112*a* from the first nozzle array L1. The fourth nozzle array L4 is provided on the opposite side of the second common liquid chamber 112*b* from the third nozzle array L3. The nozzles included in the second nozzle array L2 are connected to the first common liquid chamber 112*a* and the nozzles included in the fourth nozzle array L4 are connected to the second common liquid chamber 112*b*. The nozzles included in the first to the fourth nozzle arrays L1 to L4 are arranged in the same pitch.

In the present embodiment, the distance between nozzles adjacent to each other (long nozzle and short nozzle) in the same nozzle array in the nozzle array direction X is 1200 dpi. It is designed so that the nozzles 100*a* to 100*d* eject liquid droplets having approximately the same volume. When ejecting a plurality of color inks as liquid and recording a color image on a recording medium, the same color ink can be supplied to the first common liquid chamber 112*a* and the second common liquid chamber 112*b*. Thereby, the same color ink is ejected from all the nozzles included in the first to the fourth nozzle arrays L1 to L4.

The position of the nozzles included in the third nozzle array L3 in the nozzle array direction X is shifted from the position of the nozzles included in the first nozzle array L1 by a phase range between 90 degrees and 270 degrees. The position of the nozzles included in the fourth nozzle array L4 in the nozzle array direction X is shifted from the position of the nozzles included in the second nozzle array L2 by a phase range between 90 degrees and 270 degrees.

Here, the phase means a position in a waveform when the nozzle arrangement that forms a nozzle array is assumed to be a waveform, and two nozzles (long nozzle and short nozzle) are included in one cycle. When the long nozzles of the nozzle arrays L1 to L4 are located on the same axis in the scanning direction Y, it is defined that the phases are uniform (the same).

According to the above configuration, the recording head 101 has four types of nozzles 100*a* to 100*d* in accordance with the distance difference from the common liquid chambers 112*a* and 112*b* and the orientation difference from the common liquid chambers 112*a* and 112*b*. All of the four types of nozzles 100*a* to 100*d* are arranged substantially along the scanning direction Y. Specifically, the four types of nozzles 100*a* to 100*d* need not be arranged completely on the same axis in the scanning direction Y, and the four types of nozzles 100*a* to 100*d* are located within a range of width W that corresponds to a half cycle in the nozzle array direction X. The liquid droplets ejected from the four types of nozzles 100*a* to 100*d* located within a range of width W that corresponds to a half cycle form substantially the same pixel array on a recording medium.

Thereby, the four types of nozzles are arranged in substantially the scanning direction Y, so liquid droplets (dots) ejected from different types of nozzles coexist in substantially the same pixel array on a recording medium. Therefore, liquid droplets ejected from four types of nozzles are sequentially formed in all the pixel arrays along the scanning direction Y. Thus, even if a difference of ejection performance of the nozzles occurs for each nozzle type due to variation of manufacturing tolerance, driving condition, and operating environment, it is possible to make recording defects such as streaks and unevenness undistinguished.

In particular, even when using the recording head 101 in which the length of the nozzle arrays L1 to L4 corresponds to the recording width of recording medium and which scans only once relatively to the recording medium in the scanning direction Y perpendicular to the nozzle array direction X to perform recording, it is possible to make streaks and unevenness in the recorded image undistinguished.

In addition, the above configuration has an advantage that the nozzle density is high because the nozzles included in the nozzle arrays L1 to L4 are arranged in a zigzag pattern.

In the example shown in FIG. 3A, the position of the nozzles included in the second nozzle array L2 in the nozzle array direction X is shifted from the position of the nozzles included in the first nozzle array L1 by a phase of 180 degrees. The position of the nozzles included in the third nozzle array L3 in the nozzle array direction X is shifted from the position of the nozzles included in the first nozzle array L1 by a phase of 180 degrees. The position of the nozzles included in the fourth nozzle array L4 in the nozzle array direction X is shifted from the position of the nozzles included in the second nozzle array L2 by a phase of 180 degrees. Instead of the above, the position of the nozzles included in the second nozzle array L2 in the nozzle array direction X may have the same phase as that of the position of the nozzles included in the first nozzle array L1.

In this case, at the nth nozzle in the nozzle arrays, four different types of nozzles, which are the left-facing short nozzle 100*a*, the right-facing long nozzle 100*d*, the left-facing long nozzle 100*b*, and the right-facing short nozzle 100*c* are arranged on the same axis in the scanning direction Y. Here, n is a natural number smaller than or equal to the number of nozzles included in a nozzle array. At this time, at the adjacent pixel arrays, that is, at the (n+1)th nozzle and the (n−1)th nozzle, in the same manner as the above, four different types of nozzles 100*a*, 100*b*, 100*c*, and 100*d* are arranged on the same axis in the scanning direction Y.

In such a nozzle arrangement, when performing recording by relatively scanning a recording medium in the scanning direction Y perpendicular to the nozzle array direction X, the dots ejected from the four different nozzles 100*a* to 100*d* and landed are aligned in the same pixel array. Therefore, even if a difference of ejection characteristics occurs such as the amount and the speed of a liquid droplet ejected from the nozzles having different passage orientations and lengths, due to variation of manufacturing tolerance, driving condition, and operating environment, print defects (recording defects) such as streaks and unevenness become undistinguished.

Figure 4B:
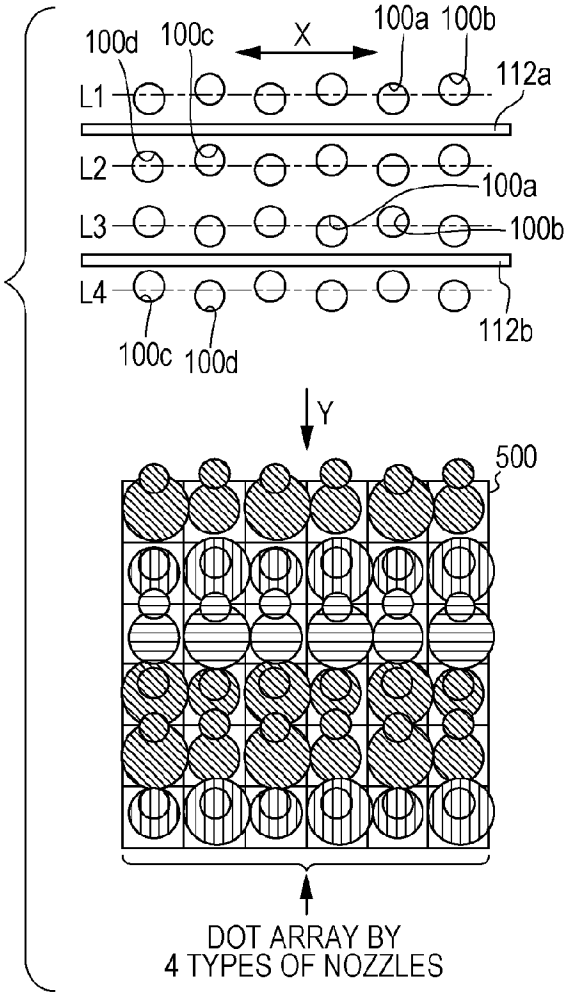
FIG. 4B is a schematic diagram showing the nozzle arrangement shown in FIG. 3A and a dot arrangement of liquid droplets formed by the nozzle arrangement.
Figure 4A:
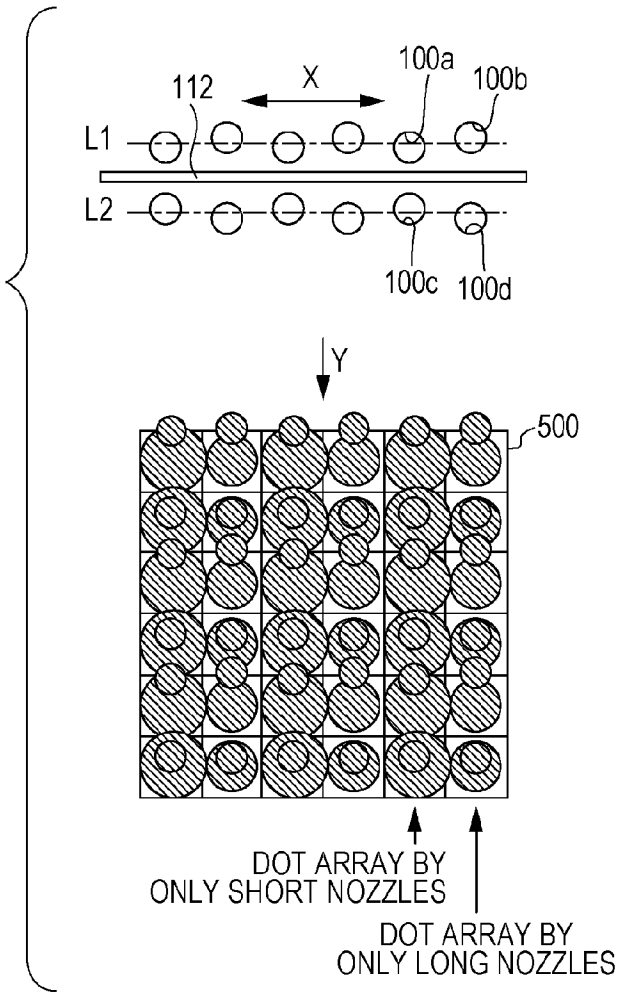
FIG. 4A is a schematic diagram showing a nozzle arrangement of a conventional example and a dot arrangement of liquid droplets formed by the nozzle arrangement.

This will be described with reference to FIG. 4. FIG. 4A shows a conventional example which includes zigzag shaped nozzle arrays on both sides of one common liquid chamber, and FIG. 4B shows an example of the present invention shown in FIG. 3A. The upper diagrams of FIGS. 4A and 4B show nozzle arrangements, and the lower diagrams show results of recording performed on the recording medium 500 by using these nozzles.

As shown in FIG. 4A, the conventional example includes two nozzle arrays L1 and L2 on both sides of one common liquid chamber 112. In the first nozzle array L1, the first nozzles 100*a* having a relatively short passage and the second nozzles 100*b* having a relatively long passage are arranged alternately. As used herein, "relatively short" means that the distance between the nozzle and the common liquid chamber 112 may range between 58 μm and 82 μm. As used herein, "relatively long" means that the distance between the nozzle and the common liquid chamber 112 may range between 106 μm and 154 μm. In the second nozzle array L2, the first nozzles 100*c* having a relatively short passage and the second nozzles 100*d* having a relatively long passage are arranged alternately. In the configuration of the conventional example, there are four types of nozzles according to differences of the orientation of the passage and the length of the passage. However, only two types of nozzles can be arranged on the same axis in the scanning direction Y because the number of the nozzle arrays is two. For example, on one scanning axis, two types of nozzles 100*b* and 100*d* having a long passage whose orientation is different from each other are arranged, and on the other scanning axis, two types of nozzles 100*a* and 100*c* having a short passage whose orientation is different from each other are arranged. In other words, combinations of the nozzles arranged on each scanning axis are different.

In each nozzle, differences of ejection characteristics such as the amount of ejection, the speed of ejection, the angle of ejection, and the like may occur according to the types of the nozzles, or differences of the flying trajectories between the main droplets and the satellite droplets may occur. In this case, differences of the shapes of liquid droplets (landed dots) landed on the recording medium 500 occur. For example, if the amount of ejection of the nozzles having a short passage is relatively large due to manufacturing tolerance, driving condition, operating environment, and the like, and relative landed positions of the main droplets and the satellite droplets are different from each other due to the orientations of the passages, density unevenness occurs as shown in the lower diagram of FIG. 4A. This is because there are a dot arrangement formed by only the long nozzles 100*b* and 100*d*, and a dot arrangement formed by only the short nozzles 100*a* and 100*c*.

On the other hand, in the recording head 101 of the present embodiment, as shown in FIG. 4B, there are four different types of nozzles 100*a* to 100*d* on all the axes. Thus, the nozzles that eject liquid toward each pixel array along the scanning direction Y include four different types of nozzles. Therefore, even if differences occur in the shapes of the landed dots due to the types of the nozzles, it is possible to reduce unevenness of image between different pixel arrays.

As described above, when the same color ink is supplied to the first common liquid chamber 112*a* and the second common liquid chamber 112*b*, the same color ink is ejected from the first to the fourth nozzle arrays L1 to L4, so it is possible to reduce unevenness of image formed by the same color.

The entire configuration of the recording head of the present embodiment is the same as that of the first embodiment, so the description thereof will be omitted. Hereinafter, an arrangement of the nozzles of the present embodiment will be described with reference to FIG. 3B.

Also in the present embodiment, there are nozzle arrays L1 to L4 arranged in a zigzag pattern on both sides of at least two common liquid chambers 112*a* and 112*b* that have a slit-like opening in the substrate 110. The pitch of the nozzles included in the nozzle arrays L1 to L4 is the same in each nozzle array.

In the present embodiment, the position of the nozzles included in the second nozzle array L2 in the nozzle array direction X is shifted from the position of the nozzles included in the first nozzle array L1 by a phase of 90 degrees. The position of the nozzles included in the third nozzle array L3 in the nozzle array direction X is shifted from the position of the nozzles included in the first nozzle array L1 by a phase of 180 degrees. The position of the nozzles included in the fourth nozzle array L4 in the nozzle array direction X is shifted from the position of the nozzles included in the second nozzle array L2 by a phase of 180 degrees. Instead of the above, the position of the nozzles included in the second nozzle array L2 in the nozzle array direction X may be shifted from the position of the nozzles included in the first nozzle array L1 by a phase of 270 degrees.

In this configuration, the distance between nozzles adjacent to each other (long nozzle and short nozzle) in one nozzle array in the nozzle array direction X is 1200 dpi. By setting the phases as described above, one of the two nozzle arrays located on both sides of the common liquid chambers 112*a* and 112*b* is shifted from the other nozzle array by ¼ cycle (a half pitch: 2400 dpi).

The distance between pixels adjacent to each other in the same pixel array on a recording medium can be the same as the distance (1200 dpi) between the nozzles adjacent to each other in the same nozzle array. In this case, the nth nozzle of the first nozzle array L1 and the nth nozzle of the second nozzle array L2 eject liquid to the same pixel array, so the two nth nozzles can be considered to be arranged on substantially the same scanning axis (axis along the scanning direction Y).

Also in the present embodiment, in the same manner as in the first embodiment, four different types of nozzles can be mixed substantially along the scanning axis. Therefore, even if there are differences in the shapes of the landed dots due to the shapes of the nozzles, it is possible to reduce unevenness between the pixel arrays.

When the same color ink is supplied to the first common liquid chamber 112*a* and the second common liquid chamber 112*b*, the same color ink is ejected from the first to the fourth nozzle arrays L1 to L4, so it is possible to reduce unevenness of image formed by the same color.

The entire configuration of the recording head of the third embodiment is the same as that of the first and the second embodiments, so the description thereof will be omitted. An arrangement of the nozzles of the present embodiment will be described with reference to FIGS. 3C, 5, and 6.

Also in the present embodiment, there are nozzle arrays L1 to L8 arranged in a zigzag pattern on both sides of at least four common liquid chambers 112*a* to 112*d* that have a slit-like opening in the substrate 110. In the present embodiment, the first common liquid chamber 112*a*, the second common liquid chamber 112*b*, the third common liquid chamber 112*c*, and the fourth common liquid chamber 112*a* can be included. The distance between nozzles adjacent to each other (long nozzle and short nozzle) in one nozzle array in the nozzle array direction X is 1200 dpi. Two nozzle arrays located on both sides of the common liquid chambers 112*a* to 112*d* are shifted from each other by ¼ cycle (a half pitch: 2400 dpi). The pitch of the nozzles included in the nozzle arrays L1 to L8 is the same in each nozzle array.

Specifically, the position of the nozzles included in the second nozzle array L2 in the nozzle array direction X is shifted from the position of the nozzles included in the first nozzle array L1 by a phase of 90 degrees or 270 degrees. The position of the nozzles included in the third nozzle array L3 in the nozzle array direction X is shifted from the position of the nozzles included in the first nozzle array L1 by a phase of 135 degrees or 315 degrees. The position of the nozzles included in the fourth nozzle array L4 in the nozzle array direction X is shifted from the position of the nozzles included in the second nozzle array L2 by a phase of 135 degrees or 315 degrees.

Similarly, the position of the nozzles included in the sixth nozzle array L6 in the nozzle array direction X is shifted from the position of the nozzles included in the fifth nozzle array L5 by a phase of 90 degrees or 270 degrees. The position of the nozzles included in the seventh nozzle array L7 in the nozzle array direction X is shifted from the position of the nozzles included in the fifth nozzle array L5 by a phase of 135 degrees or 315 degrees. The position of the nozzles included in the eighth nozzle array L8 in the nozzle array direction X is shifted from the position of the nozzles included in the seventh nozzle array L7 by a phase of 135 degrees or 315 degrees.

Further, the nozzles included in the nozzle arrays L1 to L8 are shifted from each other not to overlap each other on the same axis in the scanning direction Y. In other words, the nozzles included in the nozzle arrays L1 to L8 are relatively shifted from each other with a fine pitch in the scanning direction Y.

Figure 5:
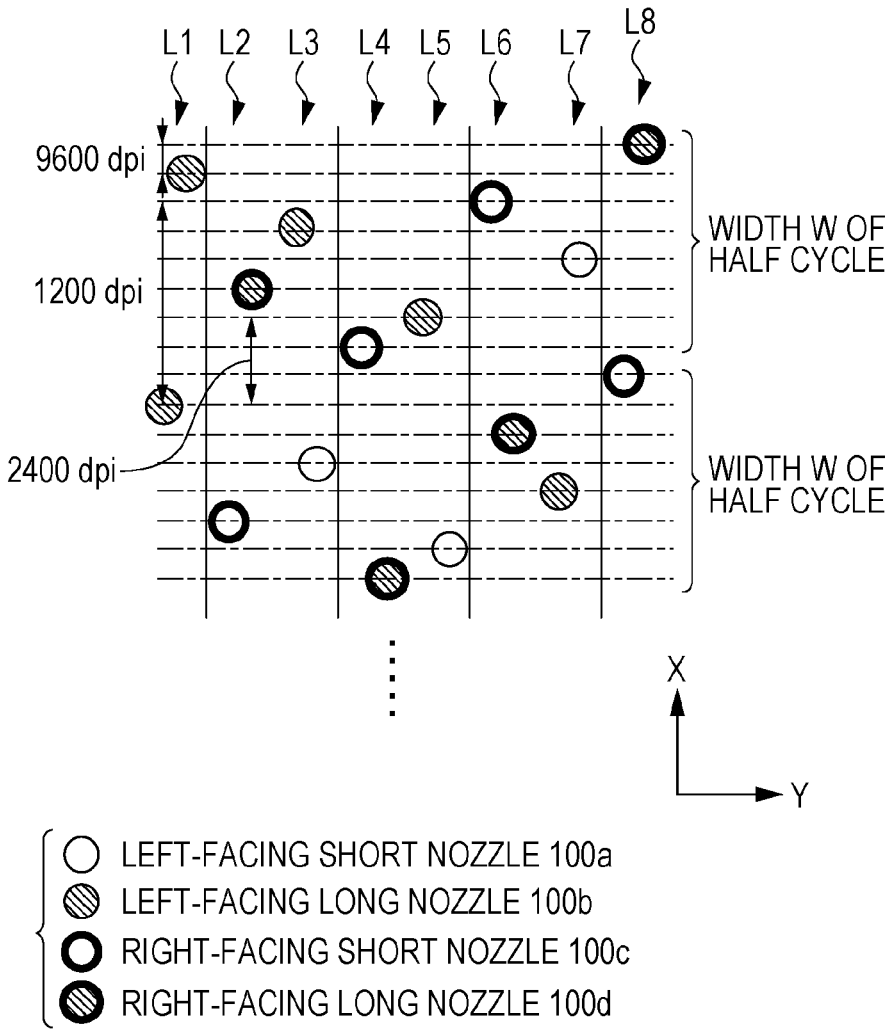
FIG. 5 is a conceptual diagram showing a nozzle arrangement of a liquid ejection head according to the third embodiment of the present invention.
Figure 6:
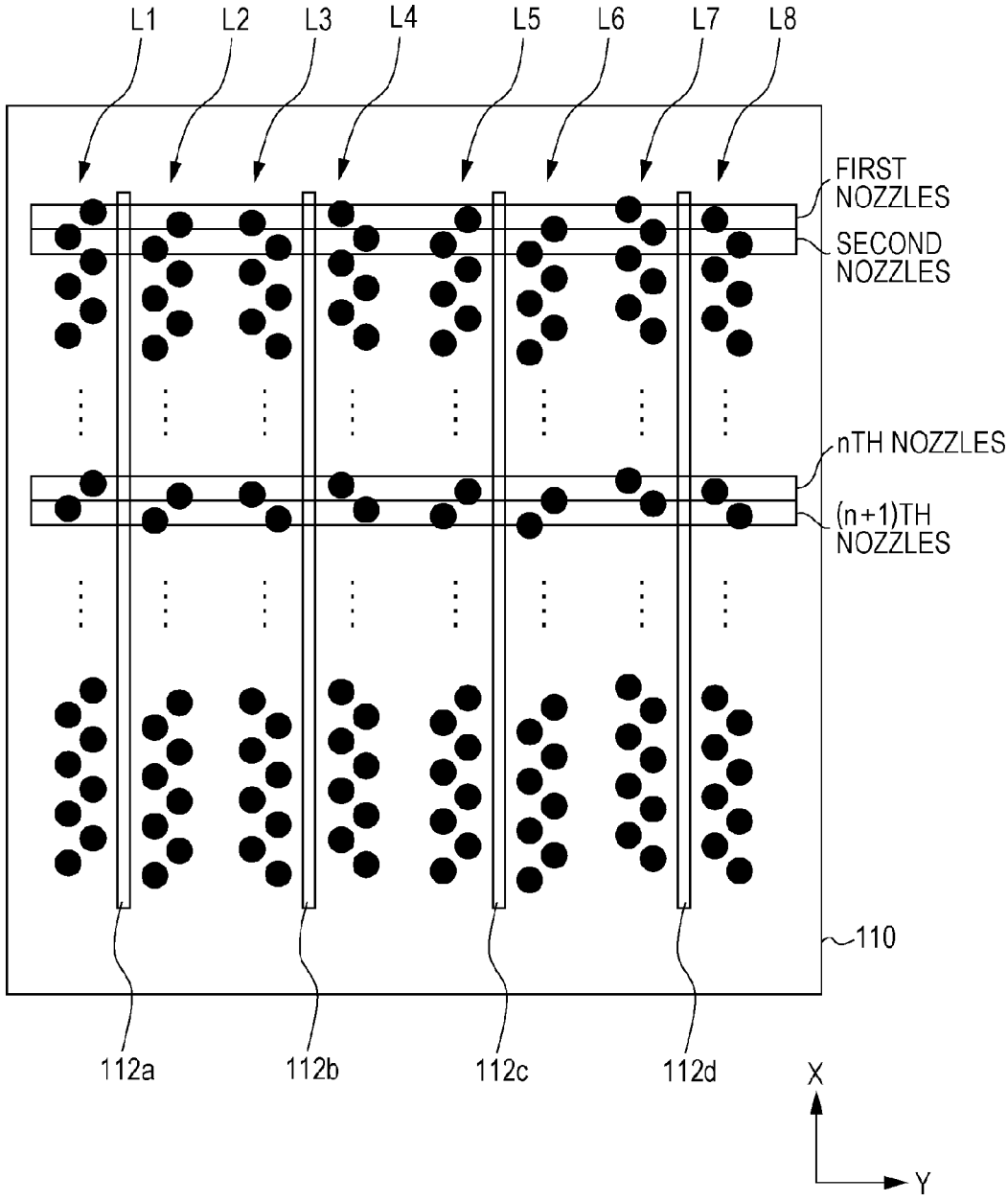
FIG. 6 is a schematic plan view showing the nozzle arrangement of the liquid ejection head according to the third embodiment of the present invention.
Figure 7A:
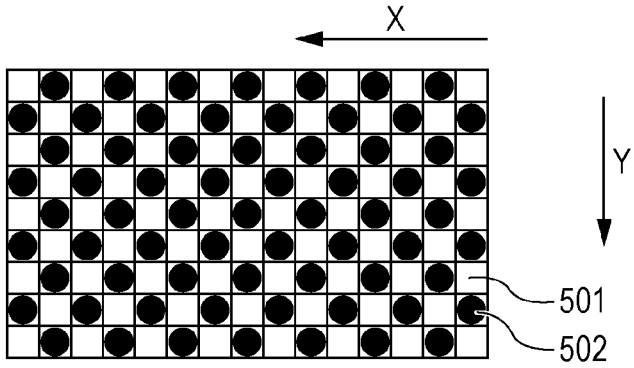
FIGS. 7A-7C are conceptual diagrams showing a conventionally known example of a method for complementing image degradation by a recording head including some defective nozzles.
Figure 7B:
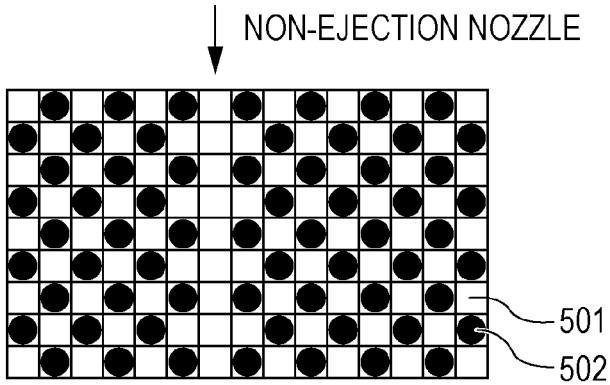
Figure 7C:
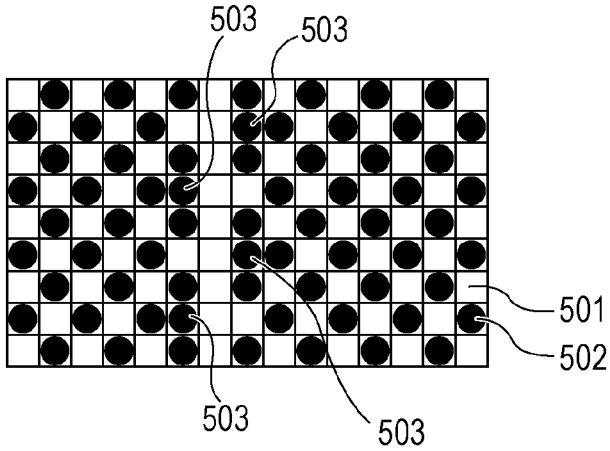
Figure 8B:
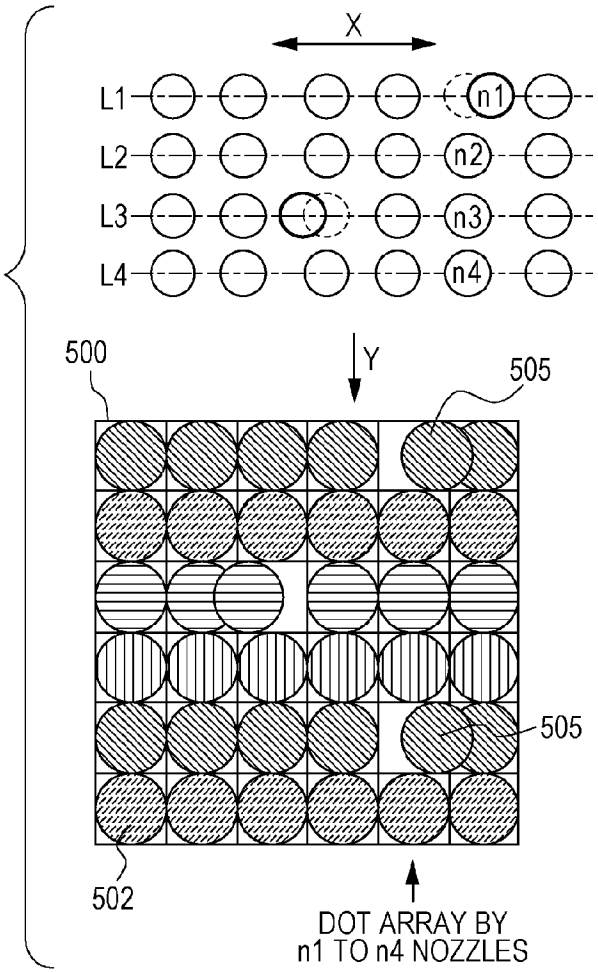
FIGS. 8A and 8B are conceptual diagrams showing an image formed on a recording medium by liquid droplets ejected from nozzles of a conventional recording head.
Figure 8A:
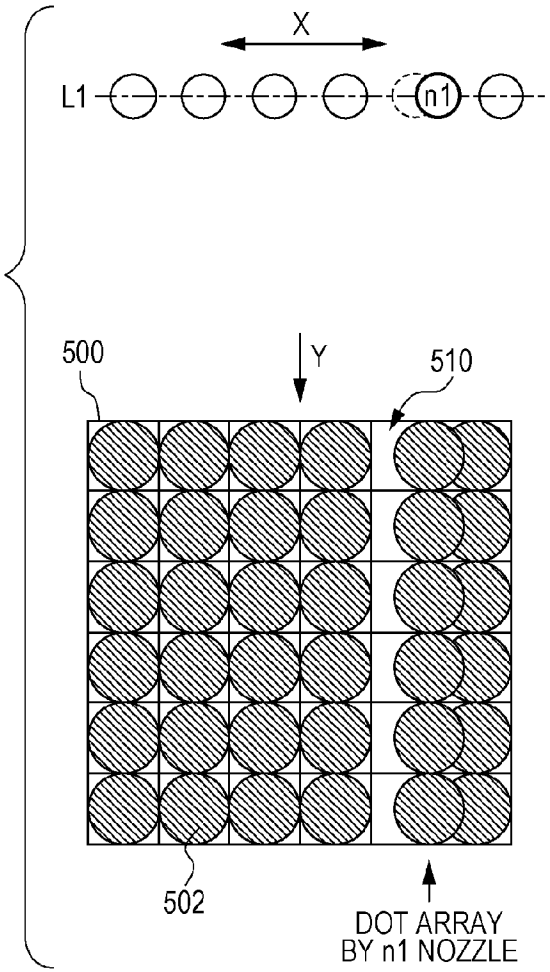
Figure 9A:
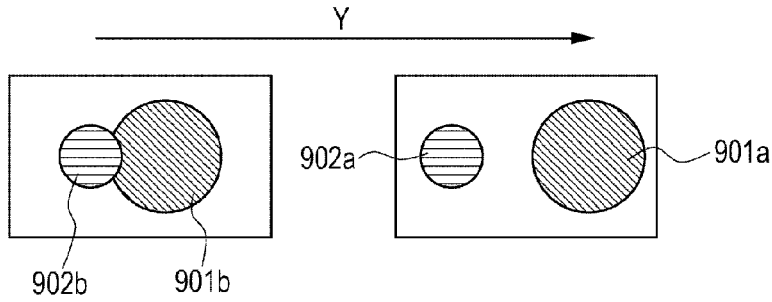
FIGS. 9A-9C are conceptual diagrams showing that misalignment of landing positions of a main droplet and a satellite droplet varies depending on the orientation of a nozzle with respect to a common liquid chamber.
Figure 9B:
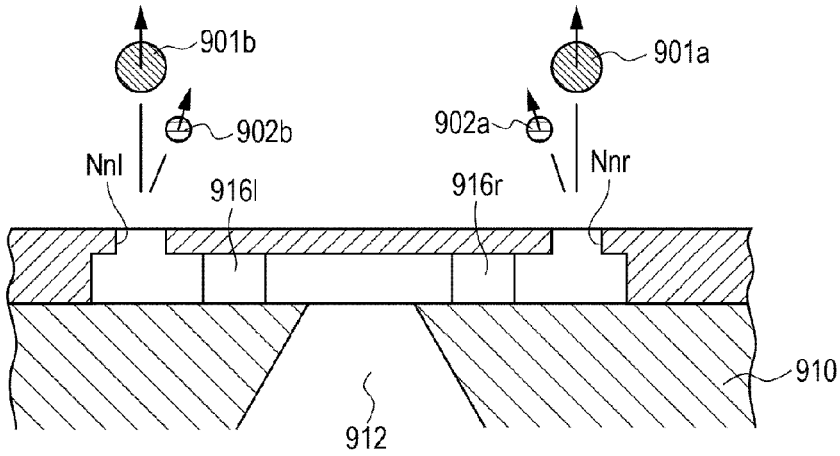
Figure 9C:
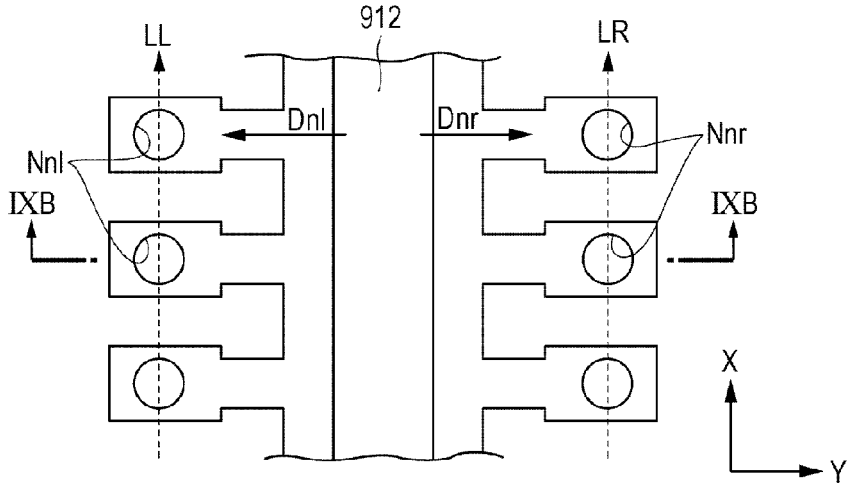

Specifically, in the third embodiment, as shown in FIG. 5, two nozzle arrays arranged on both sides of one common liquid chamber are shifted from each other by a half pitch (2400 dpi). The nozzles included in the first to the fourth nozzle arrays L1 to L4 and the nozzles included in the fifth to the eighth nozzle arrays L5 to L8 are arranged to be shifted from each other by 9600 dpi.

If the distance between pixels adjacent to each other in the same pixel array on a recording medium is set to the same as the distance (1200 dpi) between the nozzles adjacent to each other in a nozzle array, there are 8 nozzles respectively belonging to the nozzle arrays L1 to L8 on substantially the same axis along the scanning direction Y. Technically, the positions of these 8 nozzles are arranged to be shifted by 9600 dpi. In the examples shown in FIGS. 5 and 6, for example, nth nozzles of the nozzle arrays L1 to L8 include two pairs of four different types of nozzles 100*a* to 100*d* on substantially the same axis in the scanning direction Y. Specifically, two left-facing short nozzles 100*a*, two left-facing long nozzles 100*b*, two right-facing short nozzles 100*c*, and two right-facing long nozzles 100*d* are arranged on substantially the same axis in the scanning direction Y. As a result, there are two pairs of four different types of nozzles 100*a* to 100*d* in the width W of a half cycle of the nozzle arrays L1 to L8. In this case, two pairs of four different types of nozzles 100*a* to 100*d* are also arranged for the next pixel array, in other words, the (n+1)th nozzles on substantially the same axis in the scanning direction Y.

By employing such a nozzle arrangement, even when a difference of ejection characteristics occurs such as the amount and the speed of a liquid droplet ejected from the long nozzles and the short nozzles, due to variation of manufacturing tolerance, driving condition, and operating environment, it is possible to make image defects such as streaks and unevenness undistinguished. This is because dots ejected from four types of nozzles are landed and mixed on the same pixel array on a recording medium in the same manner as that in the first and the second embodiments. In particular, there is an advantage that it is possible to make image defects such as streaks and unevenness undistinguished even when a line head is used in which the length of the nozzle arrays corresponds to the width of an image recorded on a recording medium and recording is performed by scanning the recording medium only once relatively to the head.

There is an advantage that, when the same color ink is supplied to the first common liquid chamber 112*a* and the second common liquid chamber 112*b*, the same color ink is ejected from the first to the fourth nozzle arrays L1 to L4, so it is possible to reduce unevenness of image formed by the same color.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-155840 filed Jul. 8, 2010, which is hereby incorporated by reference herein in its entirety.

What is claimed is:

1. A liquid ejection head comprising:

a plurality of nozzles configured to eject liquid;

a substrate including energy generating elements configured to generate energy for ejecting liquid from the nozzles;

a first common liquid chamber and a second common liquid chamber which are formed along the substrate and into which liquid is introduced;

a first nozzle array in which a plurality of nozzles are connected to the first common liquid chamber, the plurality of nozzles including short nozzles arranged a distance from the first common liquid chamber which is relatively short and long nozzles arranged a distance from the first common liquid chamber which is relatively long, which are alternately arranged on one side of the first common liquid chamber at a predetermined pitch P along the first common liquid chamber;

a second nozzle array in which a plurality of nozzles are connected to the first common liquid chamber, the plurality of nozzles including short nozzles arranged a distance from the first common liquid chamber is relatively short and long nozzles arranged a distance from the first common liquid chamber which is relatively long, which are arranged on the other side opposite to the one side of the first common liquid chamber at the pitch P;

a third nozzle array in which a plurality of nozzles are connected to the second common liquid chamber, the plurality of nozzles including short nozzles arranged a distance from the second common liquid chamber which is relatively short and long nozzles arranged a distance from the second common liquid chamber which is relatively long, which are alternately arranged on one side of the second common liquid chamber at the pitch P along the second common liquid chamber; and a fourth nozzle array in which a plurality of nozzles are connected to the second common liquid chamber, the plurality of nozzles including short nozzles arranged a distance from the second common liquid chamber which is relatively short and long nozzles arranged a distance from the second common liquid chamber which is relatively long, which are arranged on the other side of the second common liquid chamber at the pitch P, wherein the long nozzle and the short nozzle formed on the one side and the long nozzle and the short nozzle formed on the other side are disposed within a range of the pitch P in a direction in which the plurality of nozzles are arranged.

2. The liquid ejection head according to claim 1, wherein the same color ink is supplied to the first common liquid chamber and the second common liquid chamber.

3. The liquid ejection head according to claim 1, wherein the pitch P is 1200 dpi.

4. A liquid ejection head comprising:

a plurality of nozzles configured to eject liquid;

a substrate including energy generating elements configured to generate energy for ejecting liquid from the nozzles;

a first common liquid chamber and a second common liquid chamber which are formed into slit shapes in parallel with each other in the substrate and into which liquid is introduced;

a zigzag shaped first nozzle array in which a plurality of nozzles are connected to the first common liquid chamber, the plurality of nozzles including short nozzles arranged a distance from the first common liquid chamber which is relatively short and long nozzles arranged a distance from the first common liquid chamber which is relatively long, which are alternately arranged along the first common liquid chamber on one side of the first common liquid chamber where the one side is located far from the second common liquid chamber;

a zigzag shaped second nozzle array in which nozzles are connected to the first common liquid chamber, the nozzles being formed by nozzles arranged in a pitch corresponding to the first nozzle array and provided on the other side of the first common liquid chamber opposite to the first nozzle array;

a zigzag shaped third nozzle array in which nozzles are connected to the second common liquid chamber, the nozzles being formed by nozzles arranged in the pitch corresponding to the first nozzle array and provided on one side of the second common liquid chamber where the one side is located near the first common liquid chamber; and a zigzag shaped fourth nozzle array in which nozzles are connected to the second common liquid chamber, the nozzles being formed by nozzles arranged in the pitch corresponding to the first nozzle array and provided on the other side of the second common liquid chamber opposite to the third nozzle array, wherein the position of the nozzles included in the third nozzle array in a direction along the nozzle array is shifted from the position of the nozzles included in the first nozzle array by a phase range between 90 degrees and 270 degrees, and wherein the position of the nozzles included in the fourth nozzle array in a direction along the nozzle array is shifted from the position of the nozzles included in the second nozzle array by a phase range between 90 degrees and 270 degrees.

5. The liquid ejection head according to claim 4, wherein the position of the nozzles included in the second nozzle array in a direction along the nozzle array has the same phase as that of the position of the nozzles included in the first nozzle array, or is shifted from the position of the nozzles included in the first nozzle array by a phase of 180 degrees, the position of the nozzles included in the third nozzle array in a direction along the nozzle array is shifted from the position of the nozzles included in the first nozzle array by a phase of 180 degrees, and the position of the nozzles included in the fourth nozzle array in a direction along the nozzle array is shifted from the position of the nozzles included in the second nozzle array by a phase of 180 degrees.

6. The liquid ejection head according to claim 4, wherein the position of the nozzles included in the second nozzle array in a direction along the nozzle array is shifted from the position of the nozzles included in the first nozzle array by a phase of 90 degrees or 270 degrees, the position of the nozzles included in the third nozzle array in a direction along the nozzle array is shifted from the position of the nozzles included in the first nozzle array by a phase of 180 degrees, and the position of the nozzles included in the fourth nozzle array in a direction along the nozzle array is shifted from the position of the nozzles included in the second nozzle array by a phase of 180 degrees.

7. The liquid ejection head according to claim 4, wherein the position of the nozzles included in the second nozzle array in a direction along the nozzle array is shifted from the position of the nozzles included in the first nozzle array by a phase of 90 degrees or 270 degrees, the position of the nozzles included in the third nozzle array in a direction along the nozzle array is shifted from the position of the nozzles included in the first nozzle array by a phase of 135 degrees or 315 degrees, and the position of the nozzles included in the fourth nozzle array in a direction along the nozzle array is shifted from the position of the nozzles included in the second nozzle array by a phase of 135 degrees or 315 degrees.

8. The liquid ejection head according to claim 7, further comprising:

a third common liquid chamber provided on the opposite side of the second common liquid chamber from the first common liquid chamber;

a fourth common liquid chamber provided on the opposite side of the third common liquid chamber from the second common liquid chamber;

a zigzag shaped fifth nozzle array in which nozzles are connected to the third common liquid chamber, the nozzles being formed by nozzles arranged at the same pitch as that of the first nozzle array and provided on one side of the third common liquid chamber where the one side is located near the first common liquid chamber;

a zigzag shaped sixth nozzle array in which nozzles are connected to the third common liquid chamber, the nozzles being formed by nozzles arranged at the same pitch as that of the first nozzle array and provided on the other side of the third common liquid chamber opposite to the fifth nozzle array;

a zigzag shaped seventh nozzle array in which nozzles are connected to the fourth common liquid chamber, the nozzles being formed by nozzles arranged at the same pitch as that of the first nozzle array and provided on one side of the fourth common liquid chamber where the one side is located near the first common liquid chamber; and a zigzag shaped eighth nozzle array in which nozzles are connected to the fourth common liquid chamber, the nozzles being formed by nozzles arranged at the same pitch as that of the first nozzle array and provided on the other side of the fourth common liquid chamber opposite to the seventh nozzle array, wherein the position of the nozzles included in the sixth nozzle array in a direction along the nozzle array is shifted from the position of the nozzles included in the fifth nozzle array by a phase of 90 degrees or 270 degrees, the position of the nozzles included in the seventh nozzle array in a direction along the nozzle array is shifted from the position of the nozzles included in the fifth nozzle array by a phase of 135 degrees or 315 degrees, the position of the nozzles included in the eighth nozzle array in a direction along the nozzle array is shifted from the position of the nozzles included in the sixth nozzle array by a phase of 135 degrees or 315 degrees, and the nozzles included in each nozzle array are shifted from each other not to overlap each other on the same axis in the scanning direction perpendicular to the direction along the nozzle arrays.

9. The liquid ejection head according to claim 8, wherein a plurality of color inks are ejected as the liquid to perform recording on a recording medium, and the same color ink is supplied to the first common liquid chamber, the second common liquid chamber, the third common liquid chamber, and the fourth common liquid chamber.

10. The liquid ejection head according to claim 4, wherein the liquid ejection head is a liquid ejection head configured to eject a plurality of color inks as the liquid to perform recording on a recording medium, and the same color ink is supplied to the first common liquid chamber and the second common liquid chamber.

11. The liquid ejection head according to claim 4, wherein the length of the nozzle arrays corresponds to the width of an image recorded on a recording medium, and the liquid ejection head performs recording on the recording medium by ejecting liquid while scanning the recording medium only once in a scanning direction perpendicular to the direction in which the nozzles forming the nozzle arrays are arranged.

* * * * *